US010390591B2

(12) United States Patent
Bassan

(10) Patent No.: US 10,390,591 B2
(45) Date of Patent: Aug. 27, 2019

(54) VARIABLE-SIZED FINGER RING

(71) Applicant: Vittorio Bassan, New York, NY (US)

(72) Inventor: Vittorio Bassan, New York, NY (US)

( * ) Notice: Subject to any disclaimer, the term of this patent is extended or adjusted under 35 U.S.C. 154(b) by 61 days.

(21) Appl. No.: 15/795,255

(22) Filed: Oct. 27, 2017

(65) Prior Publication Data

US 2019/0125042 A1 May 2, 2019

(51) Int. Cl.
*A44C 9/02* (2006.01)
*A44C 17/02* (2006.01)

(52) U.S. Cl.
CPC ..... *A44C 9/02* (2013.01); *A44C 17/02* (2013.01)

(58) Field of Classification Search
CPC ..... A44C 9/02; A44C 17/02
USPC ..... 63/15.5, 15.6, 15.65
See application file for complete search history.

(56) References Cited

U.S. PATENT DOCUMENTS

| | | | | |
|---|---|---|---|---|
| 2,615,314 | A | 10/1952 | Axel | |
| 2,745,266 | A | 5/1956 | Grafstein | |
| 2,778,207 | A | 1/1957 | Thaler | |
| 2,787,142 | A | 4/1957 | Axel | |
| 3,237,426 | A | 3/1966 | Doering | |
| 3,460,355 | A | 8/1969 | Lodrini | |
| 3,460,356 | A | 8/1969 | Lodrini | |
| 3,483,718 | A | 12/1969 | Lodrini | |
| 3,901,045 | A | 8/1975 | Ballester | |
| 4,471,634 | A | 9/1984 | Kaplan | |
| 6,003,334 | A | 12/1999 | Miller | |
| 6,748,764 | B1 * | 6/2004 | Roemer | A44C 9/02 63/15.5 |
| 7,409,836 | B2 | 8/2008 | Czajka et al. | |
| 7,430,879 | B2 | 10/2008 | Czajka et al. | |
| 7,845,191 | B2 | 12/2010 | Czajka et al. | |
| 7,861,554 | B2 | 1/2011 | Czajka et al. | |
| 8,573,004 | B2 | 11/2013 | Demeglio | |
| 2010/0083701 | A1 | 4/2010 | Huynh | |
| 2012/0180523 | A1 | 7/2012 | Meyerhoff et al. | |
| 2015/0296932 | A1 | 10/2015 | Escobar | |
| 2016/0021992 | A1 | 1/2016 | Podda | |

FOREIGN PATENT DOCUMENTS

| | | | |
|---|---|---|---|
| CH | 695205 | A5 | 1/2006 |
| CN | 104665132 | A | 6/2015 |
| CN | 106073071 | A | 11/2016 |
| KR | 1020070081608 | A | 8/2007 |
| KR | 20100087550 | A | 8/2010 |
| KR | 101284755 | B1 | 7/2013 |

* cited by examiner

*Primary Examiner* — Jack W Lavinder
(74) *Attorney, Agent, or Firm* — Michael P. Alexander

(57) ABSTRACT

A variable-sized finger ring includes a fixed diameter outer ring component surrounding a circumference of a finger opening, a moveable inner component positioned along a portion of the circumference of the finger opening, a compression spring elastically biasing the moveable inner component radially inwardly in relation to the fixed diameter outer ring component.

12 Claims, 11 Drawing Sheets

INTERNATIONAL RING SIZE CHART

| Circumference (mm) | Diameter (mm) | UK, Europe, & Australia | United States & Canada | CN/SG/JP | HK | Switzerland |
|---|---|---|---|---|---|---|
| 44.2 | 14.1 | P | 3 | 4 | 6 | 4 |
| 44.8 | 14.3 | P½ | | 5 | | 5½ |
| 45.3 | 14.5 | Q | 3½ | | 7.5 | |
| 46.1 | 14.7 | Q½ | | 6 | | 6½ |
| 46.8 | 14.9 | R | 4 | 7 | 9 | |
| 47.4 | 15.1 | R½ | | | | 7½ |
| 48.0 | 15.3 | S | 4½ | 8 | 10 | |
| 48.7 | 15.5 | S | | | | 8 |
| 49.3 | 15.7 | S½ | 5 | 9 | 11 | |
| 50.0 | 15.9 | T | | | | 10 |
| 50.6 | 16.1 | T½ | 5½ | 10 | 12 | |
| 51.2 | 16.3 | U | | | | 11½ |
| 51.9 | 16.5 | U½ | 6 | 11 | 13 | 12½ |
| 52.5 | 16.7 | V | | 12 | | |
| 53.1 | 16.9 | V½ | 6½ | 13 | 14.5 | 14 |
| 53.8 | 17.1 | W | | | | |
| 54.4 | 17.3 | W½ | 7 | 14 | 16 | 15½ |
| 55.1 | 17.5 | X | | | | |
| 55.7 | 17.7 | X½ | 7½ | 15 | 17 | 16½ |
| 56.3 | 17.9 | Y | | | | |
| 57.0 | 18.1 | Y½ | 8 | 16 | | 17½ |
| 57.2 | 18.2 | | | | 18 | |
| 57.6 | 18.3 | Z | | | | |
| 58.3 | 18.5 | Z½ | 8½ | 17 | 19 | |
| 58.9 | 18.8 | Z1 | | | | 19 |
| 59.5 | 19.0 | Z1½ | 9 | 18 | 20.5 | |
| 60.2 | 19.2 | Z2 | | | | 20½ |
| 60.8 | 19.4 | Z2½ | 9½ | 19 | 22 | |
| 61.4 | 19.6 | Z3 | | | | 21½ |
| 62.1 | 19.8 | Z3½ | 10 | 20 | 23 | |
| 62.7 | 20.0 | Z4 | | 21 | | |
| 63.4 | 20.2 | Z4½ | 10½ | 22 | 24 | 22½ |
| 64.0 | 20.4 | Z5 | | | | |
| 64.6 | 20.6 | Z5½ | 11 | 23 | 25 | |
| 65.3 | 20.8 | Z6 | | | | 23 |
| 65.9 | 21.0 | Z6½ | 11½ | 24 | 26 | |
| 66.6 | 21.2 | Z7 | | | | |
| 67.2 | 21.4 | Z7½ | 12 | 25 | 27.25 | 25½ |
| 67.8 | 21.6 | Z8 | | | | |
| 68.5 | 21.8 | Z8½ | 12½ | 26 | | 26½ |
| 69.1 | 22.0 | Z9 | | | | |
| 69.7 | 22.2 | | 13 | 27 | 28 | |
| 70.4 | 22.4 | Z9½ | | | | |
| 71.0 | 22.6 | | 13½ | | | |

FIG. 12

VARIABLE-SIZED FINGER RING

FIELD

The present application relates to the field of variable-sized finger rings, in particular finger rings having one or more elastically biased moveable components for auto-adjusting the size of the finger ring.

BACKGROUND

Conventional variable-sized finger ring designs include finger rings having variable diameter outer ring components, in which the diameter of the outer ring component is adjusted to vary the size of the finger ring, and finger rings having fixed diameter outer ring components with adjustable inner components. The latter category includes, for example, finger rings having manually adjustable inner components, finger rings having interchangeable inner components, and finger rings having elastically biased inner components. Examples of finger rings having fixed diameter outer ring components with elastically biased inner components include:

U.S. Pat. No. 3,460,356 (1969 Aug. 12) discloses a finger ring having a device for readily narrowing the diameter of the band of the ring, the device including a split auxiliary band embedded in a groove in the inner periphery of the main band of the ring. The split ends of the auxiliary band are connected by a flexible member which automatically draws the auxiliary band around the finger of the wearer of the band.

U.S. Pat. No. 3,483,718 (1969 Dec. 16) discloses a self-adjusting finger ring including a saddle-like insert that fits at a bottom portion of a ring for constricting the finger opening size and a leaf spring centrally secured to the insert between the saddle-like insert and the bottom portion of the ring.

U.S. Pat. No. 3,901,045 (1975 Aug. 26) discloses an expandable finger ring comprised of a major semi-circular segment for engagement about the inner and side portions of a person's finger and a moveable, spring-loaded minor segment, connected by lever means to the major segment, for pressurized engagement with the top of the finger to maintain the ring against rotational movement on the finger.

U.S. Pat. No. 6,003,334 (1999 Dec. 21) discloses a finger ring size adjustment device comprising a ring shank and a cradle which is biased radially inward from the shank. The cradle is moveable between a retracted position and an adjusted position for reducing the ring size. The cradle is biased inwardly toward the adjusted position by a leaf spring in an automatically adjustable embodiment and a lever arm in an alternate embodiment. The leaf spring is carried by the shank and is positioned for biasing the cradle radially inward from the shank to the adjusted position which position is automatically set by the finger of the user.

U.S. Pat. No. 7,409,836 (2008 Aug. 12) discloses an adjustable ring includes a ring body having an outer surface and an inner surface defining a finger opening for receiving a finger therethrough, one or more movable segments coupled to the ring portion and movable between a first position and a second position, and one or more spring elements, such as flat or wire springs, located between the movable segments and the ring body.

KR20100087550 (2010 Aug. 5) discloses a single sized ring to enable a user to wear it regardless of finger size, in which the single sized ring that includes an outer ring, an inner ring, a size adjustment tool, a tube-shaped spring insertion part, and a spring inside the spring insert part for adjusting a size of the ring.

US20120180523 (2012 Jul. 19) discloses an adjustable jewelry shank comprising a ring configures to encircle a wearer's finger and a moveable tab assembly positioned along the inner surface of the ring, in which the tab assembly is shiftable between a retracted position and an extended position, each tab assembly including a frame, a tab, and a biasing element.

U.S. Pat. No. 8,573,004 (2013 Nov. 5) discloses a ring defining a seat for being worn on a finger and has an adapter device capable of automatically adjusting the diameter of the seat. The adapter device is provided with at least one arm coupled to a structure of the ring so as to move between a retracted position and a forward position with respect to the center of the seat. The arm is pushed to the forward position by at least one elongated spring, which substantially extends in a circumferential direction and has a first end portion fixed to either the structure or the arm, and a second end portion, opposite to the first and arranged resting against the other of either the structure or the arm.

CN104665132 (2015 Jun. 3) discloses a finger size-adjustable finger ring comprising a finger ring and an arc-shaped elastic plate having one end fixed on an inner wall of the finger ring and another end of the elastic plate extending to a space surrounded by the finger ring.

However, there remains a need for a variable-sized finger ring with a combination of improved functionality, excellent aesthetic appearance, and durability to last a lifetime.

SUMMARY

According to the present description, a variable-sized finger ring includes: a fixed diameter outer ring component surrounding a circumference of a finger opening; a moveable inner component positioned along a portion of the circumference of the finger opening; and a compression spring elastically biasing the moveable inner component radially inwardly in relation to the fixed diameter outer ring component.

The fixed diameter outer ring component includes any ring body with a fixed diameter. The structure of the ring body is not limited by size, shape, configuration, design, or material. It is understood in the context of the present description that many ring bodies may be permanently resized, such as by stretching the ring body, to customize a fit to a particular user to alter a diameter to fit a changing finger size of a user. In the context of the present description, the term "fixed" diameter includes ring bodies that are capable of permanent resizing, such as by stretching the ring body. Thus, ring bodies that are capable of permanent resizing, such as by stretching, are considered to have a "fixed" diameter for the purposes of the present description.

The moveable inner component includes any moveable structure positioned along a portion of the circumference of the finger opening. The moveable structure is not limited by size, shape, configuration, design, or material.

The compression spring includes any elastic structure that is elastically compressible between the moveable inner component and the fixed diameter outer ring component. By way of the elastic compressibility, the compression spring elastically biases the moveable inner component radially inwardly in relation to the fixed diameter outer ring component. Thereby, the moveable inner component can be moved radially inwardly and radially outwardly to auto-adjust a size of the variable-sized finger ring.

According to the present description, the compression spring includes a central member pressing against the fixed diameter outer ring component and being held against shifting in a circumferential direction, a first spring arm connected to the central member and pressing against the moveable inner component, and a second spring arm connected to the central member and pressing against the moveable inner component.

It is understood in the context of the present description that the central member is held against overall shifting in a circumferential direction, in which the circumferential direction refers to a direction aligned with or primarily aligned with the circumference of the fixed diameter outer ring component. Holding the central member against shifting in a circumferential direction facilitates improved functionality of the variable-sized ring such that the compression spring maintains its position and the central member in combination with the first and second spring arms repeatedly and uniformly elastically bias the moveable inner component radially inwardly in relation to the fixed diameter outer ring component throughout a lifetime of use of the variable-sized ring. As evident from the detailed disclosure, it is understood that the term "held" does not require the central member to be affixed to the outer ring component and permits movement of portions of the central member to implement other features of the present description.

In an aspect of the present description, the central member may include a first radially outwardly positioned portion, wherein the fixed diameter outer ring component includes a first groove therein that retains the first radially outwardly positioned portion of the central member.

In another aspect of the present description, the central member may further include a second radially outwardly positioned portion, wherein the fixed diameter outer ring component includes a second groove therein that retains the second radially outwardly positioned portion of the central member.

By way of retaining the first and/or second radially outwardly positioned portions of the central member within the first groove of the fixed diameter outer ring component, the central member may be held against shifting in a circumferential direction. It is understood that retaining a radially outwardly positioned portion of a central member within a groove of a fixed diameter outer ring component is one exemplary configuration for holding the central member against shifting in a circumferential direction, and other configurations for holding the central member against shifting in a circumferential direction may be employed.

The grooves include any structure capable of retaining the first and second radially outwardly positioned portions of the central member. As evident from the detailed disclosure, the first radially outwardly positioned portion of the compression spring may contact yet remain unfixed to the groove of the fixed diameter outer ring component, and thus compression of the compression spring may inevitably result in relative movement between the surface of the first radially outwardly positioned portion of the central member and the surface of the groove of the fixed diameter outer ring component.

In yet another aspect of the present description, the central member may include a first radially outwardly positioned portion, and wherein the fixed diameter outer ring component includes a first gemstone gallery accommodating a first gemstone and a second gemstone gallery accommodating a second gemstone, and wherein the first radially outwardly positioned portion of the central member is positioned directly between the first gemstone gallery and the second gemstone gallery.

In yet another aspect of the present description, the central member may include a first radially outwardly positioned portion and a second radially outwardly positioned portion, wherein the fixed diameter outer ring component includes a first gemstone gallery accommodating a first gemstone, and wherein the first gemstone galley is positioned directly between the first radially outwardly positioned portion of the central member and the second radially outwardly positioned portion of the central member.

In the present description, gemstone galleries refer to locations at which gemstones are actually placed or locations at which gemstones are configured to be placed.

In yet another aspect of the present description, the central member may include a tension spring portion between the first spring arm and the second spring arm to elastically bias the first spring arm toward the second spring arm. The tension spring portion receives a tension load that elastically deforms the tension spring portion, which aids in the compression spring elastically biasing the moveable inner component radially inwardly in relation to the fixed diameter outer ring component. By the term "tension load," it is understand that the tension spring portion receives an overall net tension load, even if the tension spring may or may not receive a mixture of compression and tension loads throughout portions thereof.

In yet another aspect of the present description, the central member may include a first radially outwardly positioned portion, a second radially outwardly positioned portion, and a tension spring portion connected between the first radially outwardly positioned portion of the central member and the second radially outwardly positioned portion of the central member.

In yet another aspect of the present description, the fixed diameter outer ring component may include a first gemstone gallery accommodating a first gemstone, and wherein the tension spring portion is positioned directly between the first gemstone gallery and the moveable inner component.

In yet another aspect of the present description, the first gemstone gallery may be positioned directly between the first radially outwardly positioned portion of the central member and the second radially outwardly positioned portion of the central member.

In yet another aspect of the present description, the first radially outwardly positioned portion may be formed by a junction between the first spring arm and the tension spring portion of the central member, and the second radially outwardly positioned portion is formed by a junction between the second spring arm and the tension spring portion of the central member.

Additional aspects of the variable-sized finger ring include the following, which may be considered in isolation as well as in combination with any one or more other aspects of the variable-sized finger ring.

According to one or more additional aspects of the present description, the ring body, the moveable inner component, and/or the compression spring may be fabricated from a precious metal or alloy, e.g., gold, white gold, platinum, etc., to resist corrosion and maintain a desirable appearance for a lifetime of the user. Preferably, the compression spring is formed from a gold alloy having high elasticity.

According to one or more additional aspects of the present description, the variable-sized finger ring may include a pair of moveable inner components positioned along opposing portions of the circumference of the finger opening; and a compression spring elastically biasing each moveable inner component radially inwardly in relation to the fixed diameter outer ring component, in which the moveable inner components and compression springs may include one or more other features as previously or hereafter described.

According to one or more additional aspects of the present description, a configuration of the ring body may advantageously include configurations that do not permit for easy resizing, such as eternity bands. Thus, the present description provides for an ability to auto-adjust a size of a finger ring configuration that does not permit for easy resizing.

According to one or more additional aspects of the present description, the ring body may include a circumferential recess, such as a channel, in an inner diameter surface of the ring body, and the moveable inner component may be received into the channel to hide the moveable inner component from view.

According to one or more additional aspects of the present description, the ring body may include a radial array of lower baskets defining an inner fixed diameter of the finger ring, in which the lower baskets may be interconnected with each, and in which the lower baskets may define a channel for receiving a moveable inner component.

According to one or more additional aspects of the present description, the ring body may include a radial array of upper baskets, in which each upper basket may define a circumference around a gemstone gallery for accommodating a gemstone therein, and in which the upper baskets 12 may be not interconnected with each other.

According to one or more additional aspects of the present description, the ring body may include plurality of prongs for each gemstone, each prong connected to at least one of a lower basket and an upper basket, and in which a groove may be formed into one or more the prongs for retaining a radially outwardly positioned portion of the central member.

According to one or more additional aspects of the present description, the moveable inner component may have an arc-shaped inner surface, preferably with a radius of curvature that is substantially similar to an inner diameter surface of the ring body, to become substantially flush with the inner diameter surface of the ring body when the bar is moved to a retracted position.

According to one or more additional aspects of the present description, the moveable inner component may include a circumferential recess, such as a channel, in a radially outward facing surface of the moveable inner component, and the compression spring may be received into the channel to prevent a shifting of the compression spring with respect to an axial direction of the variable-sized ring.

According to one or more additional aspects of the present description, the moveable inner component may be in the form of a rigid structure, i.e., a bar, and the bar may have elasticity sufficient to enable easy and lasting assembly. Such assembly may include elastically deforming the moveable inner component to fit into an opening formed in the fixed diameter outer ring component that would be too small except for the ability of the moveable inner component to elastically deform. The moveable inner component may reverse the elastic deformation upon passing through the opening to facilitate retaining the moveable inner component in the fixed diameter outer ring component.

According to one or more additional aspects of the present description, the variable-sized ring may include one or more additional features illustrated in the accompanying drawings, in which the accompanying drawings show an exemplary embodiment of a variable-sized ring that is designed with specific detailed configurations and sizes for each of the components. In particular, the detailed configuration and size of the compression spring is believed to maximize the intended function of the compression spring, and the present description is intended to include all the features illustrated, even if not described, in this written specification.

According to one or more additional aspects of the present description, the compression spring has a one-dimensional (i.e., line-shaped) configuration, in which the one-dimensional compression spring may have a substantially uniform cross-section along a length of the compression spring. As evident from the detailed disclosure, the one-dimensional configuration of the compression spring may include curved portions that may be formed directly into the desired configuration, such as by machining, or bent into the desired configuration.

According to one or more additional aspects of the present description, the variable-sized ring may achieve a ring size auto-adjustment of at least 1½ ring size (United States Ring Size Standard).

Other aspects of the disclosed variable-sized finger ring will become apparent from the following detailed description, the accompanying drawings and the appended claims.

BRIEF DESCRIPTION OF THE DRAWINGS

FIG. 12 shows an international ring size chart correlating United States ring size with other international ring sizes and ring circumference and diameter.

DETAILED DESCRIPTION

By the terms "radially inwardly" and "radially outwardly" it is understood in the context of the present description that radially inwardly and outwardly respectively refer to directions that are aligned with or primarily aligned with inward and outward directions of a radius of the fixed diameter outer ring component. By the term "circumferential" direction, it is understood in the context of the present description that a circumferential direction refers to a direction that is aligned with or primarily aligned with a circumference of the fixed diameter outer ring component. By the term "axial" direction, it is understood in the context of the present description that an axial direction refers to a direction that is aligned with or primarily aligned with the axis of the fixed diameter outer ring component.

The following detailed description is intended to describe aspects of the variable-sized finger ring in sufficient detail to enable those skilled in the art to practice in the invention. While the variable-sized finger ring is hereafter described in detail with reference to an illustrated embodiment, it is not intended that the scope of the invention be limited only to the illustrated embodiment. Persons skilled in the art will recognize that various changes may occur in the details without departing from the invention as defined in the claims.

Figure 2:
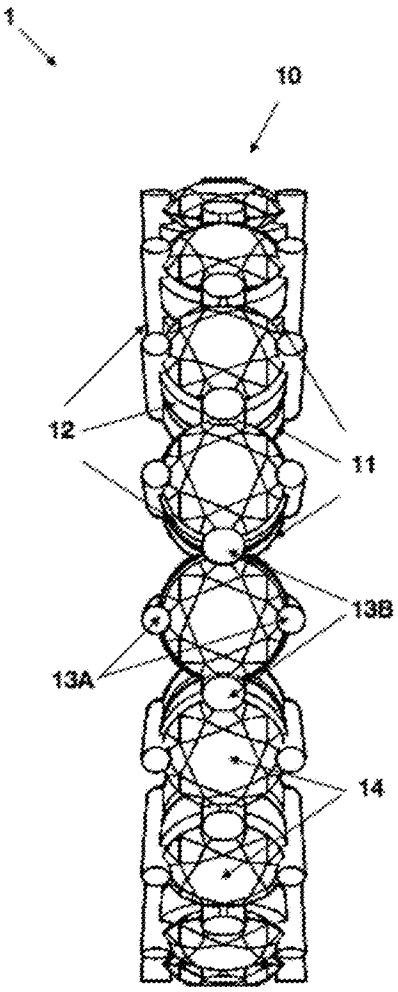
FIG. 2 represents left side, right side, top, and bottom views of the variable-sized ring of FIG. 1.
Figure 1:
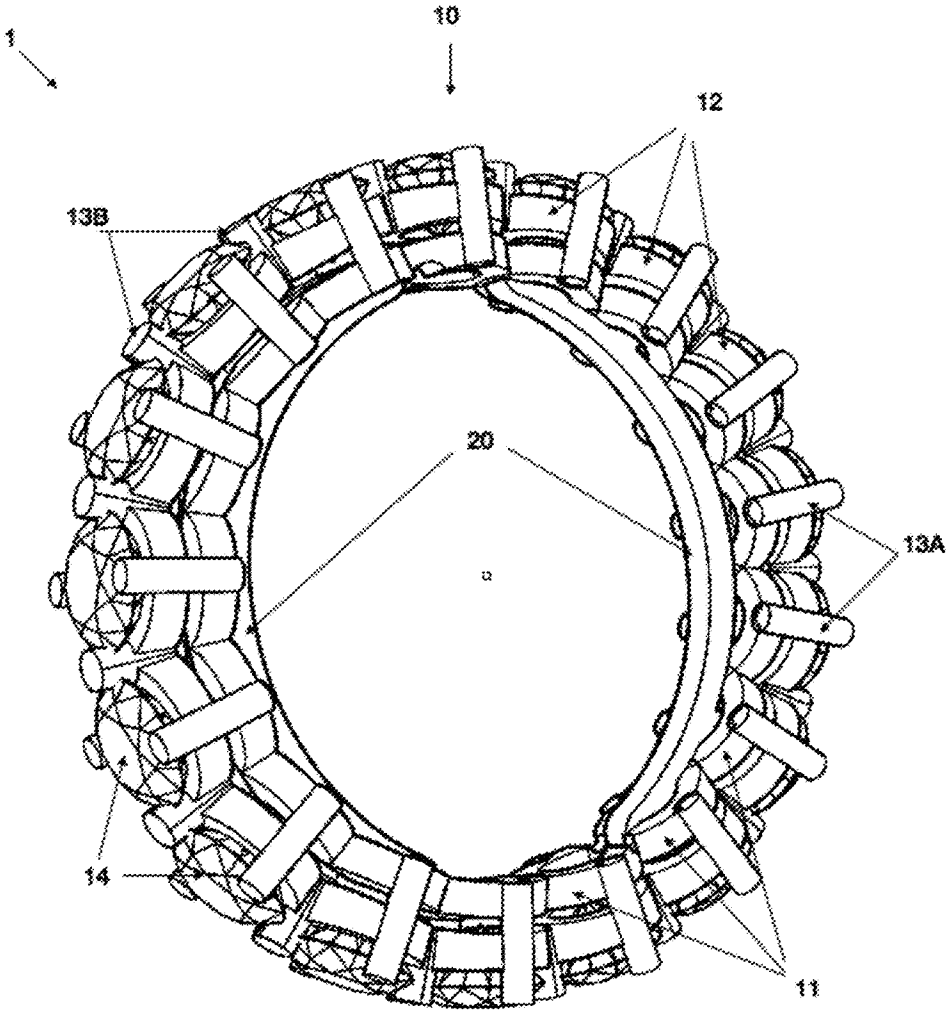
FIG. 1 represents a perspective view of an exemplary embodiment of a variable-sized ring of the present description.
Figure 3:
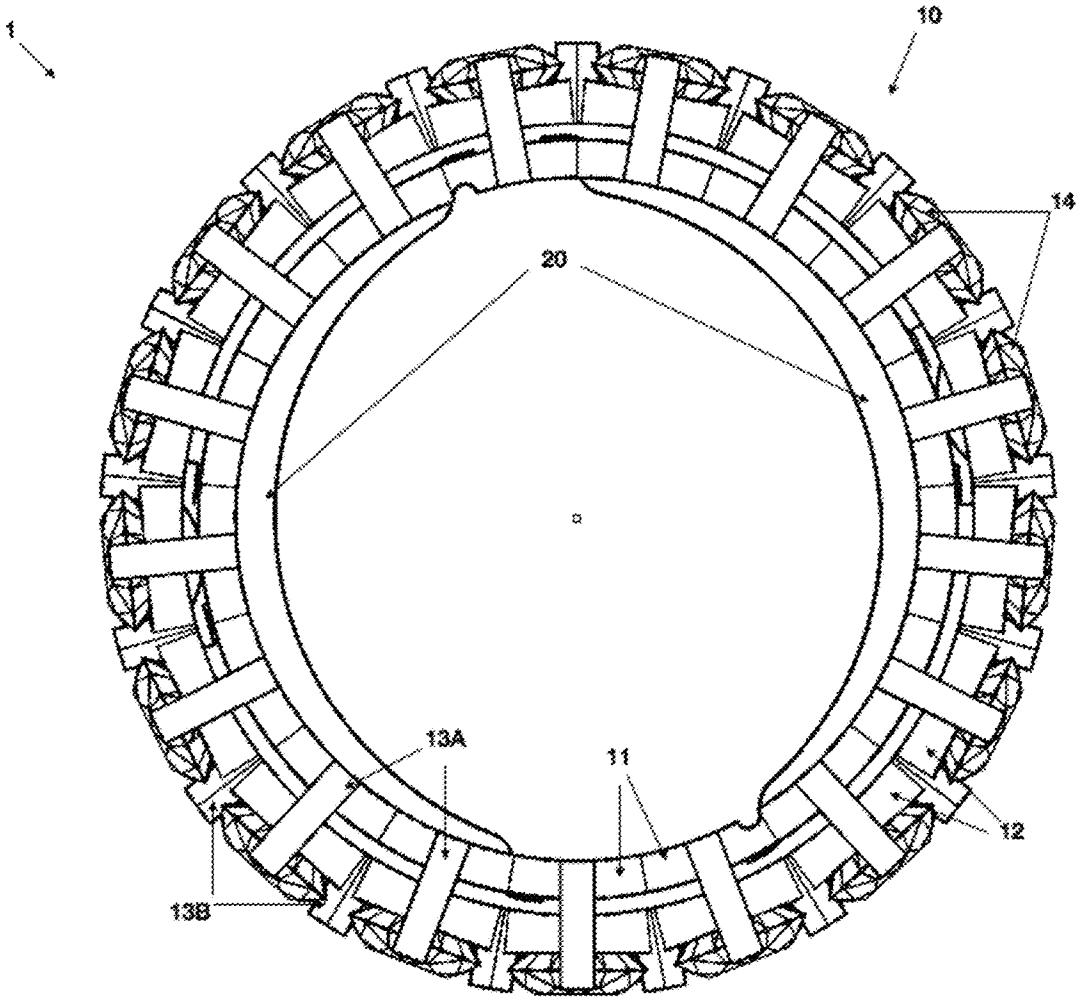
FIG. 3 represents front and rear views of the variable-sized ring of FIG. 1.
Figure 4:
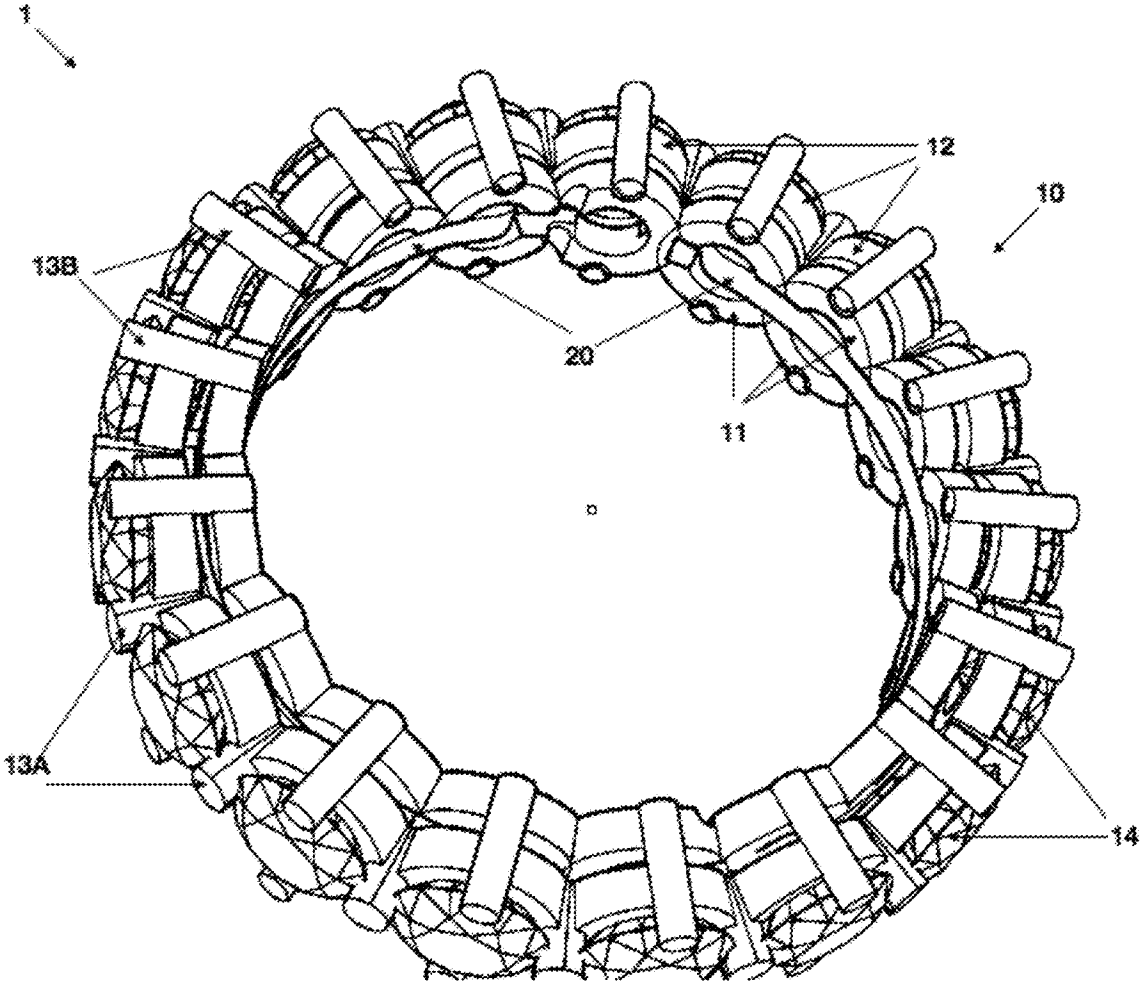
FIG. 4 represents a perspective view of the variable-sized ring of FIG. 1 showing the movable bars in a retracted position.
Figure 5:
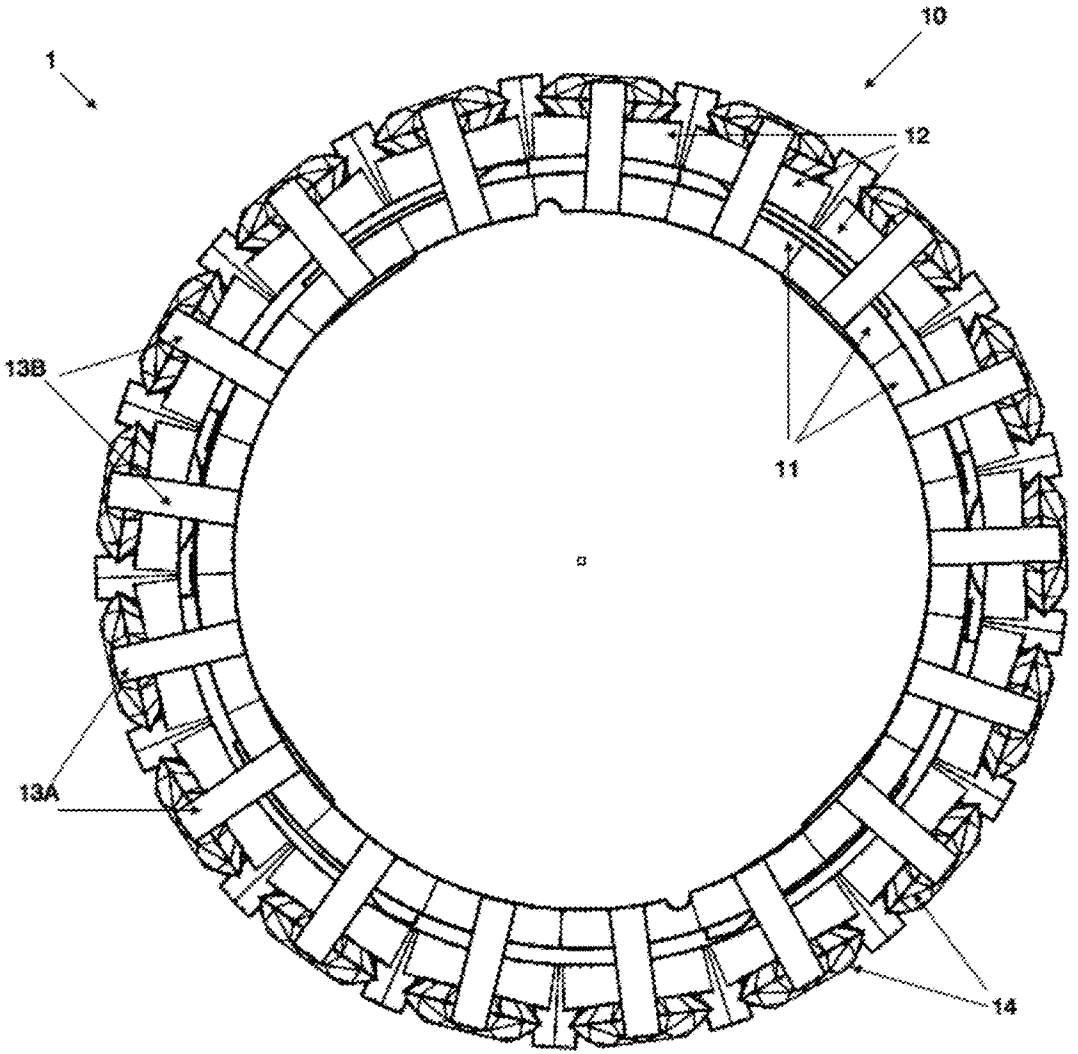
FIG. 5 represents front and rear views of the variable-sized ring of FIG. 4.

Referring now to the drawings in which like numerals indicate like elements throughout the several figures, FIGS. 1 to 5 illustrate an exemplary embodiment of a variable-sized ring of the present description. FIG. 1 represents a perspective view of the variable-sized ring. FIG. 2 represents left side, right side, top, and bottom views of the variable-sized ring of FIG. 1. FIG. 3 represents front and rear views of the variable-sized ring of FIG. 1. FIG. 4 represents a perspective view of the variable-sized ring of FIG. 1 showing the movable bars in a retracted position. FIG. 5 represents front and rear views of the variable-sized ring of FIG. 4.

As shown in FIGS. 1 to 5, the variable sized ring 1 includes a ring body 10, moveable bars 20 and compression springs (hidden). The ring body 10 surrounds a circumference of a finger opening and defines a fixed diameter of the finger ring 1. As shown, the ring body 10 includes lower baskets 11, upper baskets 12, prongs 13, and gemstones 14. The lower baskets 11 include a radial array of lower baskets including a first lower basket, a second lower basket, a third lower basket, etc. The lower baskets 11 define an inner fixed diameter of the finger ring 1. As further shown, the lower baskets 11 are interconnected with each other to form a simple and durable structure of the inner diameter of the ring body 1. With reference to FIG. 4, the lower baskets 11 define channels for receiving the moveable bars 20 in a retracted position.

The upper baskets 12 include a radial array of upper baskets including a first upper basket, a second upper basket, a third upper basket, etc. Each upper basket 12 defines a circumference around a gallery for accommodating a gemstone 14 therein. As further shown, the upper baskets 12 are not interconnected with each other.

The prongs include unshared prongs 13A and shared prongs 13B. As shown, each unshared prongs 13A rises outwardly from a lower basket 11 to beyond an upper basket 12, and each shared prong 13B rises outwardly from an upper basket 12. The unshared prongs 13A function to fix each upper basket 12 to a respective lower basket 11, and the shared prongs 13B function to function each upper basket 12 to adjacent upper baskets 12. The unshared prongs 13A and shared prongs 13B function together to secure a gemstone 14 within the gallery defined by each upper basket 12. In this regard, the unshared prongs 13A and shared prongs 13B have grooves therein to engage with the girdle of the adjacent gemstones.

As shown, the moveable bars 20 include a first moveable bar and a second moveable bar opposing the first moveable bar. A comparison of FIGS. 1 to 3 with FIGS. 4 to 5 shows that the moveable bars 20 are moveable between an extended position and a retracted position to auto-adjust a diameter of the variable-sized finger ring 1. When in the retracted position, the moveable bars 20 are fully or partially retracted within the channels defined in the lower baskets 11.

Figure 6:
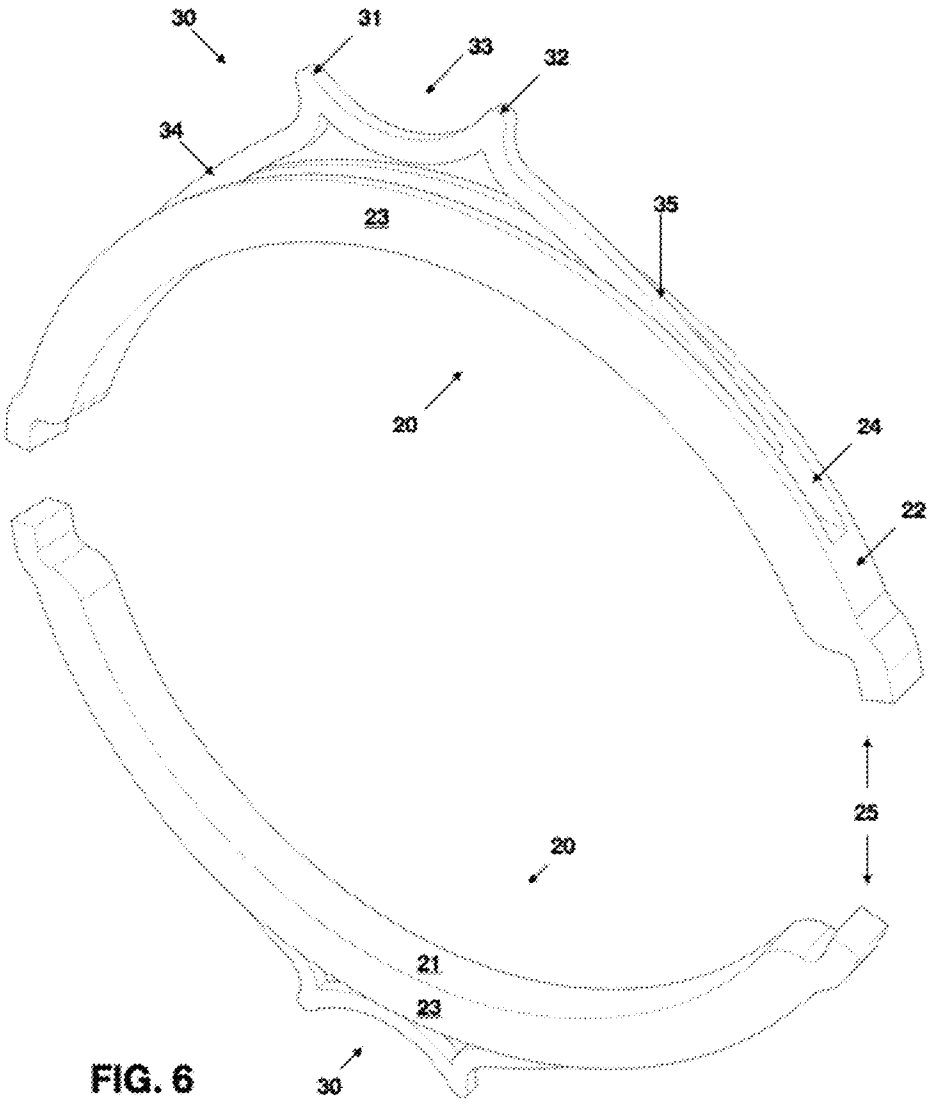
FIG. 6 represents a perspective view of bars and springs of the variable-sized ring of FIG. 1
Figure 7:
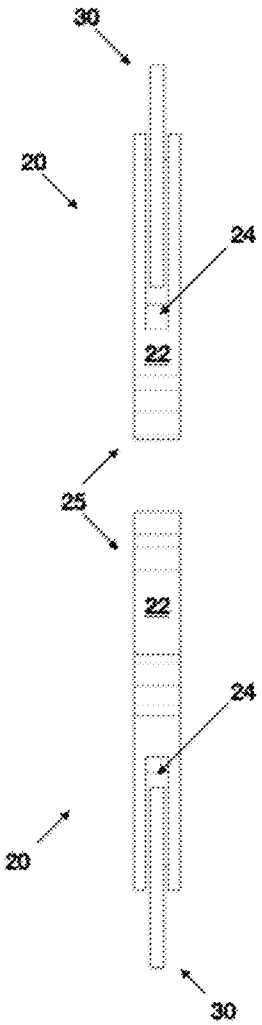
FIG. 7 represents left and right side views of the bars and springs of FIG. 6.
Figure 8:
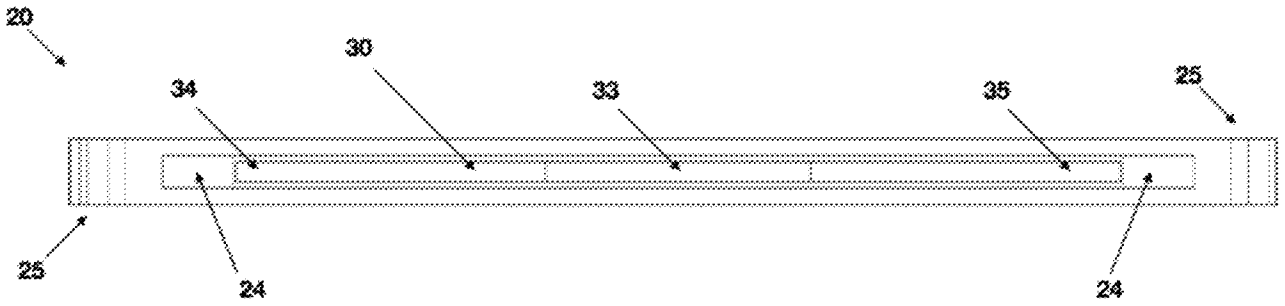
FIG. 8 represents top and bottom views of the bars and springs of FIG. 6.
Figure 9:
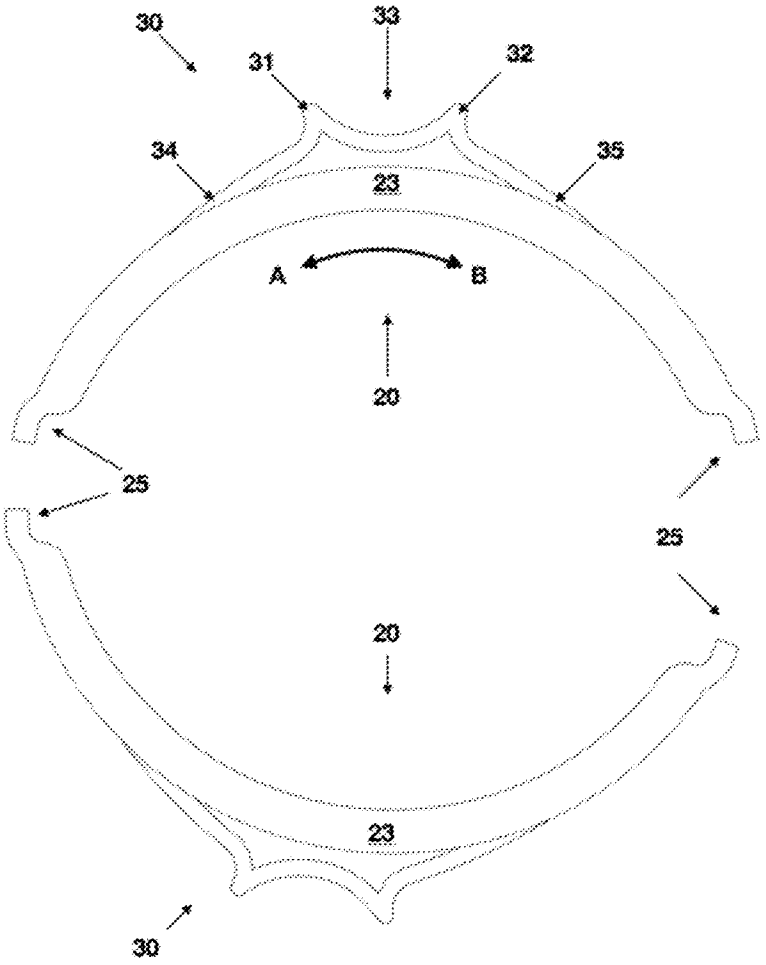
FIG. 9 represents front and rear views of the bars and springs of FIG. 6.

FIGS. 6 to 9 illustrate a perspective view of bars and springs of the variable-sized ring. FIG. 6 represents a perspective view of the bars and springs. FIG. 7 represents left and right side views of the bars and springs. FIG. 8 represents top and bottom views of the bars and springs. FIG. 9 represents front and rear views of the bars and springs.

As illustrated in FIGS. 6 to 9, the variable sized ring 1 includes first and second moveable bars 20 and first and second compression springs 30, in which the compression spring 30 engages with the first moveable bar 20 and the second compression spring 30 engages with the second moveable bar 20.

The moveable bars 20 have a radially inward facing surface 21, a radially outward facing surface 22, and a pair of side surfaces 23. The radially inward facing surface 21 is concave, and the radially outward facing surface 22 is convex, and both the radially inward facing surface 21 and the radially outward facing surface 22 have an arcuate shape with a radius of curvature that is substantially similar to that of the ring body 10.

The moveable bars 20 further include a channel 24 formed into the radially outward facing surface 22 of the moveable bars. The channel 24 is formed as a recess portion in the radially outward facing surface 22 and is defined by parallel opposing surfaces positioned along opposing sides of the channel 24. The moveable bars 20 further include retaining members 25 formed at opposing ends of the moveable bars 20.

The compression springs 30 each include a central member, first spring arm 34, and a second spring arm 35. The first spring arm 34 is disposed from a first side of the central member in a first circumferential direction A, and the second spring arm 35 is disposed from a second side of the central member in a second circumferential direction B. The first and second spring arms 34, 35 include a first end that is disposed circumferentially outwardly away from the central member and a second end that is disposed both circumferentially inwardly toward the central member and radially outwardly from the moveable bar 20.

The central member of the compression springs 30 includes a first radially outwardly disposed member 31, a second radially outwardly disposed member 32, and a tension spring portion 33. The tension spring portion 33 is connected between the first radially outwardly positioned portion 31 and the second radially outwardly positioned portion 32, and the tension spring portion 33 includes a first radially outwardly positioned end, a second radially outwardly positioned end, and a half moon portion that curves radially inwardly between the first and second radially outwardly positioned ends of the tension spring portion 33.

The first radially outwardly positioned portion 31 is formed by a junction of the circumferentially-inwardly/radially-outwardly positioned end of the first spring arm 34 and one of the radially outwardly positioned portions of the tension spring portion 33. The second radially outwardly positioned portion 32 is formed by a junction of the circumferentially-inwardly/radially-outwardly positioned portion of the second spring arm 35 and another radially outwardly positioned portion of the tension spring portion 33.

The compression spring 30 is elastically compressible between the moveable bar 20 and the ring body 10. By way of its elastically compressibility, the compression spring 30 elastically biases the moveable bar radially inwardly in relation to the ring body 10. Thereby, the moveable bar 20 moves to auto-adjust a size of the finger ring.

The compression springs 30 have a width small enough to fit at least partially within the channels 24 of the moveable bars 20. By fitting the compression springs 30 within the channels 24 of the moveable bars 20, disengagement between the moveable bars 20 and compression springs 30 due to an axial shifting therebetween is prevented.

The variable-sized ring has been designed with a specific overall detailed configuration and size, as illustrated, which is believed to maximize the function of the variable-sized ring. Therefore, in addition to the general description of the configuration and dimensions of the variable-sized ring explicitly included within the summary, the detailed description and the claims of the present application, other inherent aspects and inherent advantages of the variable-sized ring as illustrated will become apparent, and the present application is intended to include any inherent but undescribed aspects and advantages of the configurations and dimensions of the illustrated variable-sized ring. In particular, the compression spring 30 has been designed with a specific overall detailed configuration and size, as illustrated, which is believed to maximize the function of the compression spring 30. The present application is intended to include any inherent but undescribed aspects and advantages of the configurations and dimensions of the illustrated compression spring.

Figure 10:
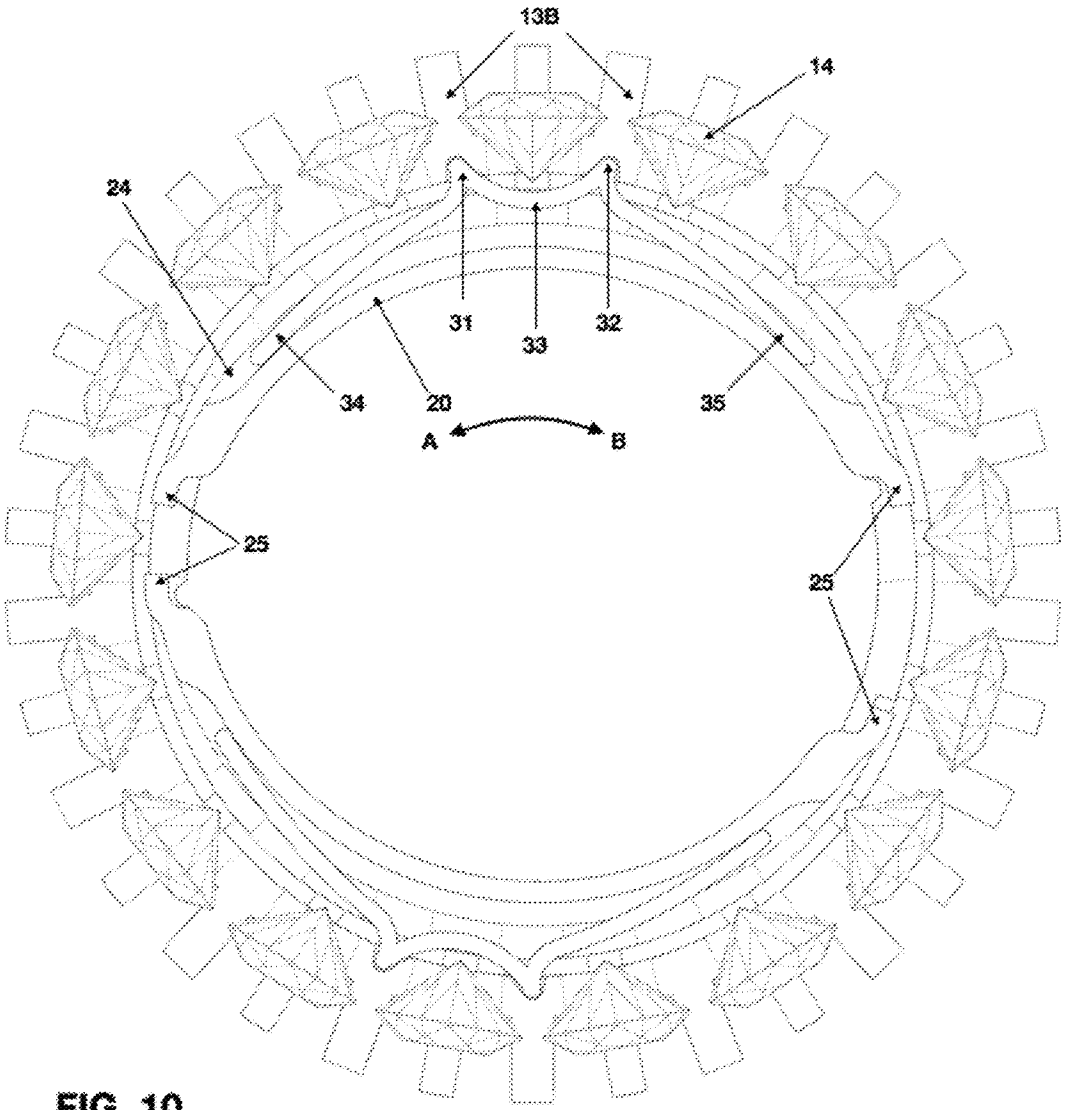
FIG. 10 illustrates a front and rear sectional view of the variable-sized finger ring as illustrated in FIGS. 1 to 9, having the moveable bars elastically biased radially inwardly towards an extended position.
Figure 11:
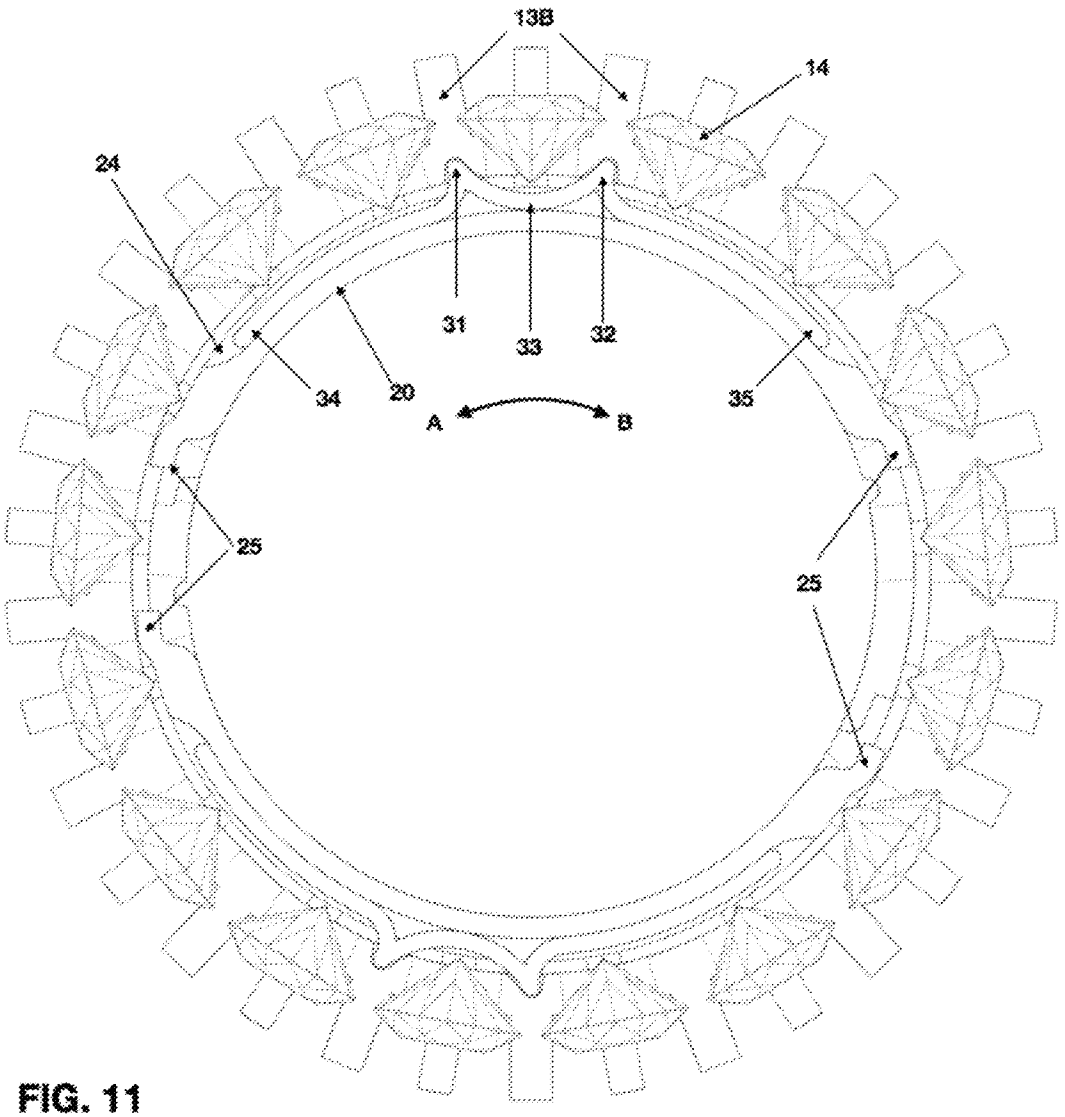
FIG. 11 represents the front and rear section view of FIG. 10 having the moveable bars in a retracted position and the compression springs in a compressed state.

FIGS. 10 and 11 illustrate a front or rear sectional view of the variable-sized finger ring as illustrated in FIGS. 1 to 9. FIG. 10 represents the front or rear section view having the moveable bars elastically biased radially inwardly towards an extended position. FIG. 11 represents the front or rear section view having the moveable bars in a retracted position and the compression springs in a compressed state.

As illustrated, the variable-sized finger ring includes the ring body 10 having a fixed diameter surrounding a circumference of a finger opening, first and second moveable bars 20 positioned along a portion of the circumference of the finger opening, and first and second compression springs 30 elastically biasing the moveable bars 20 radially inwardly in relation to the ring body 10. The compression spring 30 each include a central member circumferentially held in relation to the ring body 10, a first spring arm 34 disposed from the central member in a first circumferential direction A and applying a force against the moveable bar 20, and a second spring arm 35 disposed from the central member in a second circumferential direction B opposite the first circumferential direction A and applying a force against the moveable bar 20.

The central member includes first and second radially outwardly positioned portions 31, 32 applying a force against the ring body 10.

The ring body 10 includes a first groove therein that retains the first radially outwardly positioned portion 31, and a second groove that retains the second radially outwardly positioned portion 32.

The ring body 10 includes a plurality of gemstone galleries 14 accommodating a plurality of gemstones, and the radially outwardly positioned portion 31, 32 is disposed radially outwardly to between adjacent gemstone galleries 14 and to opposing sides of a gemstone gallery 14 disposed between the radially outwardly positioned portions 31, 32.

The central member comprises a tension spring portion 33 elastically resisting a separation of the first and second spring arms 34, 35 and connected between the first radially outwardly positioned portion of the central member and the second radially outwardly positioned portion of the central member 34, 35.

The first radially outwardly positioned portions 31 are formed by a connection between a radially outwardly positioned portion of the first spring arm 34 and a first radially outwardly positioned portion of the tension spring 33, and wherein the second radially outwardly positioned portion 32 is formed by a connection between a radially outwardly positioned portion of the second spring arm 35 and a second radially outwardly positioned portion of the tension spring 33.

As illustrated, the ring body 10 includes a circumferential recess in the inner diameter surface for receiving the moveable bar 20, to hide the moveable bar 20 from view, and the moveable bar 20 has an arc-shaped concave surface, with a radius of curvature that is substantially similar to the inner diameter of the ring body 10, to become substantially flush with the inner diameter of the ring body 10 when the moveable bar 20 is moved to a retracted position.

A prototype of the variable-sized finger ring has been manufactured substantially as described and illustrated and described in the detailed description. It was found that the variable-sized finger ring, and particularly the novel configuration of the compression spring, advantageously provided for an improved functionality, excellent aesthetic appearance, and expected durability to last a lifetime.

With regard to improved functionality, the configuration of the compression spring was shown to provide for a smooth, repeatable, and uniformly applied elastic biasing of the pair of moveable bars in relation to the ring body to auto-adjust a size of the finger ring to vary within a range of approximately 1.75 ring sizes (United States Standard Ring Size). FIG. 12 shows an international ring size chart correlating United States ring size with other international ring sizes and ring circumference and diameter.

With regard to excellent aesthetic appearance, the configuration of the variable-sized ring permits for a hidden functionality of the ring auto-adjustment mechanism, the configuration of the compression spring permits for thin ring body designs, the positioning the of the compression spring within the ring body permits for a small impact of the size auto-adjusting mechanism on the overall profile of the finger ring, while otherwise minimizing design constraints.

With regard to excellent durability, all the of the components of the ring body may be fabricated from precious metals to ensure corrosion resistance for a lifetime, and the minimal shape complexity of the compression spring is expected to ensure continued functionality in the presence of inevitable environmental challenges that are imposed upon rings by their users.

Although various embodiments of the disclosed variable-sized finger ring have been shown and described, modifications may occur to those skilled in the art upon reading the specification. The present application includes such modifications and is limited only by the scope of the claims.

What is claimed is:

1. A variable-sized finger ring, comprising:

a fixed diameter outer ring component surrounding a circumference of a finger opening;

a single moveable inner component positioned along a portion of the circumference of the finger opening; and a compression spring elastically biasing the single moveable inner component radially inwardly in relation to the fixed diameter outer ring component, the compression spring comprising:

a central member pressing against the fixed diameter outer ring component and being held against shifting in a circumferential direction;

a first spring arm connected to the central member and pressing against the single moveable inner component, and a second spring arm connected to the central member and pressing against the single moveable inner component.

2. The variable-sized finger ring of claim 1, wherein the central member comprises a first radially outwardly positioned portion, and wherein the fixed diameter outer ring component includes a first groove therein that retains the first radially outwardly positioned portion of the central member.

3. The variable-sized finger ring of claim 2, wherein the central member further comprises a second radially outwardly positioned portion, and wherein the fixed diameter outer ring component includes a second groove therein that retains the second radially outwardly positioned portion of the central member.

4. The variable-sized finger ring of claim 1, wherein the central member comprises a first radially outwardly positioned portion, wherein the fixed diameter outer ring component includes a first gemstone gallery accommodating a first gemstone and a second gemstone gallery accommodating a second gemstone, and wherein the first radially outwardly positioned portion of the central member is positioned directly between the first gemstone gallery and the second gemstone gallery.

5. The variable-sized finger ring of claim 1, wherein the central member comprises a first radially outwardly positioned portion and a second radially outwardly positioned portion, wherein the fixed diameter outer ring component includes a first gemstone gallery accommodating a first gemstone, and wherein the first gemstone galley is positioned directly between the first radially outwardly positioned portion of the central member and the second radially outwardly positioned portion of the central member.

6. The variable-sized finger ring of claim 1, wherein the central member comprises a tension spring portion between the first spring arm and the second spring arm to elastically bias the first spring arm toward the second spring arm.

7. The variable-sized finger ring of claim 1, wherein the central member comprises a first radially outwardly positioned portion;

a second radially outwardly positioned portion; and a tension spring portion connected between the first radially outwardly positioned portion of the central member and the second radially outwardly positioned portion of the central member.

8. The variable-sized finger ring of claim 7, wherein the fixed diameter outer ring component includes a first gemstone gallery accommodating a first gemstone, and wherein the tension spring portion is positioned directly between the first gemstone gallery and the single moveable inner component.

9. The variable-sized finger ring of claim 8, wherein the first gemstone gallery is positioned directly between the first radially outwardly positioned portion of the central member and the second radially outwardly positioned portion of the central member.

10. The variable-sized finger ring of claim 7, wherein the first radially outwardly positioned portion is formed by a junction between the first spring arm and the tension spring portion of the central member, and the second radially outwardly positioned portion is formed by a junction between the second spring arm and the tension spring portion of the central member.

11. The variable-sized finger ring of claim 1, wherein the compression spring is manufactured from a gold alloy.

12. The variable-sized finger ring of claim 1, wherein end portions of the first and second spring arms press against the single moveable component.

* * * * *